US006547614B2

(12) United States Patent
Wagner

(10) Patent No.: US 6,547,614 B2
(45) Date of Patent: Apr. 15, 2003

(54) PERSONAL FLOTATION DEVICE CONSTRUCTION METHOD

(75) Inventor: Steven G. Wagner, Waterloo (CA)

(73) Assignee: Salus Marine Wear Inc., Waterloo (CA)

( * ) Notice: Subject to any disclaimer, the term of this patent is extended or adjusted under 35 U.S.C. 154(b) by 0 days.

(21) Appl. No.: 09/972,154

(22) Filed: Oct. 9, 2001

(65) Prior Publication Data

US 2002/0049016 A1 Apr. 25, 2002

Related U.S. Application Data

(60) Provisional application No. 60/238,023, filed on Oct. 6, 2000.

(51) Int. Cl.[7] ..... B63C 9/08
(52) U.S. Cl. ..... 441/106; 442/223
(58) Field of Search ..... 441/106, 107, 441/112, 113; 428/35.2; 442/223

(56) References Cited

U.S. PATENT DOCUMENTS 1,218,291 A * 3/1917 Meinecke ..... 114/219
1,271,154 A * 7/1918 Garrison ..... 441/112
3,647,305 A * 3/1972 Baker et al. ..... 401/7
3,661,690 A * 5/1972 Taranto ..... 428/71
3,663,973 A * 5/1972 Spence ..... 5/655.5
3,702,484 A * 11/1972 Tobinick et al. ..... 5/655.5
3,776,644 A * 12/1973 Baker ..... 428/121
4,044,180 A * 8/1977 Baker ..... 428/35.2
4,304,824 A * 12/1981 Karpinski ..... 428/157
4,424,600 A * 1/1984 Callaway ..... 5/502
4,515,840 A * 5/1985 Gatward ..... 428/211
4,847,931 A * 7/1989 Bard ..... 5/644
4,972,534 A * 11/1990 Hutton ..... 5/502
5,060,314 A * 10/1991 Lewis ..... 441/112
5,660,572 A * 8/1997 Buck ..... 441/106
6,235,661 B1 * 5/2001 Khanamirian ..... 441/112

* cited by examiner

*Primary Examiner*—S. Joseph Morano
*Assistant Examiner*—Lars A. Olson
(74) *Attorney, Agent, or Firm*—L. Anne Kinsman; Borden Ladner Gervais LLP

(57) ABSTRACT

A personal flotation device (PFD) with flotation foam is disclosed. A soft PFD, or a life jacket, is made up of a number of individual pockets in which flotation foam is enclosed to provide buoyancy. An additional layer of soft foam is fastened between the flotation foam and the material forming one side of each individual pocket to create a rounded edge that covers the harder edges of the flotation foam that cause user discomfort. To manufacture the soft PFD, two layers of material are first fastened to each other at their edges to form at least one open pocket. A soft foam layer is fastened by its edges to the exterior of one or both of the material layers, or simultaneously as the two material layers are fastened together. The open pocket is subsequently turned inside out to form an inverted pocket. This causes the material layer with the fastened soft foam layer to round out. Flotation foam is then inserted into the inverted pocket, which is subsequently closed.

20 Claims, 5 Drawing Sheets

PERSONAL FLOTATION DEVICE CONSTRUCTION METHOD

This application claims the benefit of Provisional application Ser. No. 60/238,023, filed Oct. 6, 2000.

FIELD OF THE INVENTION

The present invention relates generally to personal flotation devices. More particularly, the present invention relates to a method for constructing or fabricating a personal flotation device having a flotation foam core.

BACKGROUND OF THE INVENTION

Personal flotation devices (PFD's) and life jackets are commonly used in recreational water sports as a safety apparatus to prevent accidental death due to drowning. This is primarily achieved through the use of buoyant materials in the PFD which help support the body near the water surface, particularly the head and face of the wearer, so they may float on or near the surface with little or no effort. FIGS. 1 and 2 show front and back views of a typical PFD. PFD 20 has the form of a vest with openings for a wearer's neck, arms and waist. A strap 22 with a locking buckle allows the wearer to secure the vest around their torso.

Many users tend to remove the PFD during their activity, or abstain from wearing the PFD altogether because they find the PFD uncomfortable. This discomfort occurs mainly due to the nature of the flotation foam within the PFD. The flotation foam must meet safety regulations such as the U.S. Coast Guard Regulations and the Canadian General Standard Board (CGSB), while preferably minimizing bulk to allow sufficient freedom of arm and shoulder mobility demanded by recreational water sports. Hard foams are typically used due to their low cost and high buoyancy characteristics. Examples of hard foams include closed cell polyethylene and polypropylene foams. One type of closed cell polypropylene foam is an FF2C foam. Hard foam does not conform well to a person's body, and is therefore found to be uncomfortable during use. Accordingly, there is a concern that people are not wearing their PFD's due to the discomfort experienced, and hence have an increased risk of mortality.

Much of the comfort of a PFD is derived from the softness, shape and placement of its flotation foam. The common method for construction of PFD's with such foam is described below with reference to FIGS. 3 through 5. FIGS. 3 through 5 illustrate cross-sectional views of the PFD along line A—A in FIG. 1 or line B—B in FIG. 2 at various stages of construction. The PED can be constructed of multiple small pockets to increase its flexibility, and accordingly, the cross-sectional images can be representative of a single pocket.

As shown in FIG. 3, the construction of typical PFD's begins by placing a shell material 24 back-to-back with a liner material 26 such that the outside surfaces are facing each other as shown in FIG. 3. The edges of the shell 24 and liner 26 are sewn together as illustrated by stitches 28 to form a pocket. In FIG. 4, the shell 24 and liner 26 are turned inside out such that their respective outside surfaces are facing outwards and the stitching is now on the inside of the pocket. Once the pocket has been turned inside out, it can be stuffed with flotation foam. FIG. 5 illustrates the pocket stuffed with different layers of foam. The layers 30 and 32 are typically hard foam, but can also be soft foam, arranged in various combinations. Examples of soft foams are those commonly sold under the trademarks "ENSOLITE" and "AIREX". FIG. 6 illustrates an alternative stuffing of a single piece of hard or soft foam 34 with tapered edges to increase comfort to the wearer.

Unfortunately, the hard foam 32 in FIG. 5 has edges that are a source of discomfort. In the alternative stuffing of FIG. 6, the hard or soft foam 34 with tapered edges may increase the cost and time for manufacturing the PFD because the edges must be formed, for example, through cutting the hard foam 34 prior to its insertion into the pocket. Consequently, there is wasted foam as a result of the cutting process.

It is, therefore, desirable to provide a PFD that is comfortable to wear while remaining inexpensive to produce, for augmenting PFD use.

SUMMARY OF THE INVENTION

It is an object of the present invention to obviate or mitigate at least one disadvantage of previous personal flotation devices and methods for constructing personal flotation devices. It is a particular object to provide a low cost, comfortable personal flotation device.

In a first aspect, the present invention provides a personal flotation device. The personal flotation devices includes at least one pocket having two material layers directly fastened to each other, at least one soft foam layer fastened to at least one of the two material layers, and flotation foam positioned between the soft foam layer and the other of the two material layers.

In farther embodiments of the first aspect, the two material layers are fastened to each other at their edges and the at least one soft foam layer is fastened to one of the two material layers at its edges. Furthermore, the two material layers include a lining and a shell and the at least one soft foam layer is fastened to the shell.

In yet another embodiment of the first aspect, the at least one pocket is an inverted pocket, and the flotation foam includes hard foam or layers of hard foam and soft foam. In further aspects of the present embodiment, the at least one soft foam layer is sewn, glued, taped or heat laminated to one of the two material layers.

In other embodiments of the first aspect, one soft foam layer is fastened to each of the two material layers, and the at least one soft foam layer and the at least one of the two material layers have a convex shape.

In another aspect, the present invention provides a method for manufacturing a personal flotation device. The method includes the steps of fastening a first material to a second material at their edges to form an open pocket and fastening a soft foam layer to the exterior of the first material by its edges. In subsequent steps, the open pocket is turned to form an inverted pocket, a flotation foam is inserted into the inverted pocket, and open ends of the inverted pocket are fastened together. In a further embodiment of the present aspect, the soft foam layer, the shell and the liner are simultaneously sewn together at their edges.

In further alternate embodiments of the present aspect, the soft foam layer is sewn, glued, taped or heat laminated to the exterior of the first material.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a soft personal flotation device (PFD) and a method for manufacturing a soft PFD. The soft PFD, or life Jacket, is made up of a number of individual pockets in which flotation foam is enclosed to provide buoyancy. An additional layer of soft foam is fastened between the flotation foam and the material forming one side of each individual pocket to create a rounded edge that covers the harder edges of the flotation foam that cause user discomfort. To manufacture the soft PFD, two layers of material are first fastened to each other at their edges to form at least one open pocket. A soft foam layer is fastened by its edges to the exterior of one or both of the material layers, or simultaneously as the two material layers are fastened together. The open pocket is subsequently turned inside out to form an inverted pocket. This causes the material layer with the fastened soft foam layer to round out. Flotation foam is then inserted into the inverted pocket, which is subsequently closed.

The embodiments of the present invention are directed to inherently buoyant PFD's as opposed to the inflatable type of PFD's. The PFD's manufactured according to embodiments of the present invention are better fitting and more comfortable than prior art PFD's, and do not cost more to manufacture than prior art PFD's that provide similar levels of comfort.

An embodiment of the structure and method for manufacturing the PFD of the present invention is discussed with reference to FIGS. 1, 2 and 7 through 10.

Figure 1:
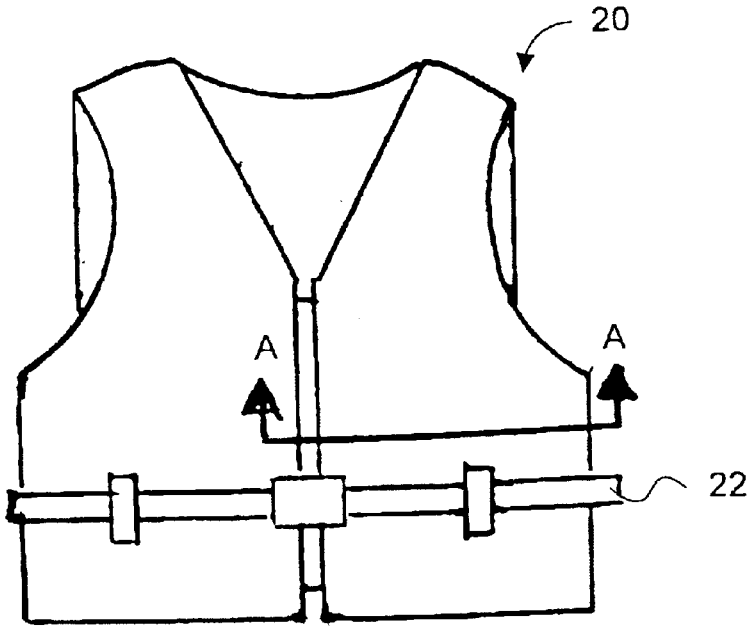
FIG. 1 is an elevated frontal view of a typical PFD.
Figure 2:
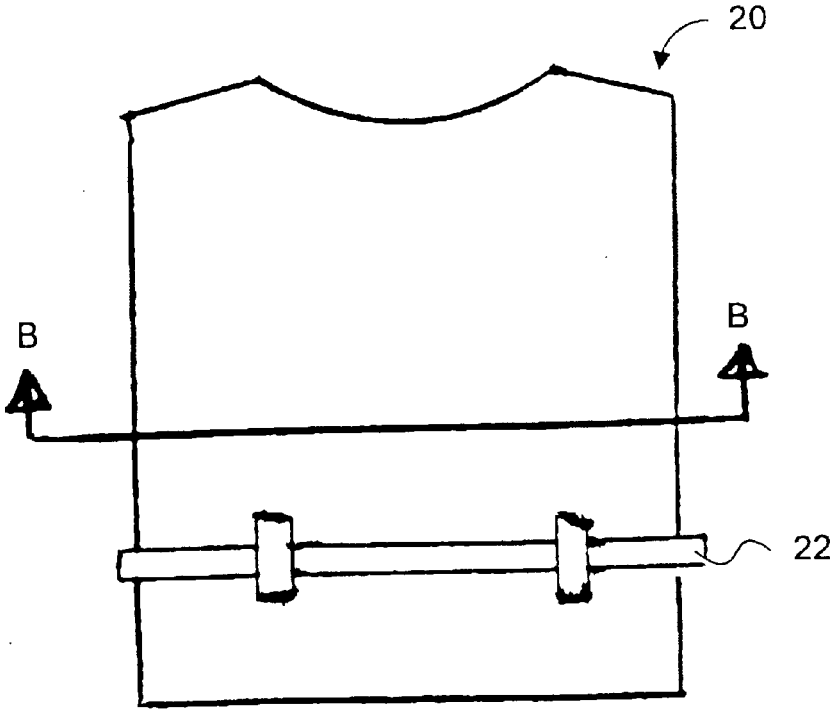
FIG. 2 is an elevated back view the PFD shown in FIG. 1.
Figure 3:
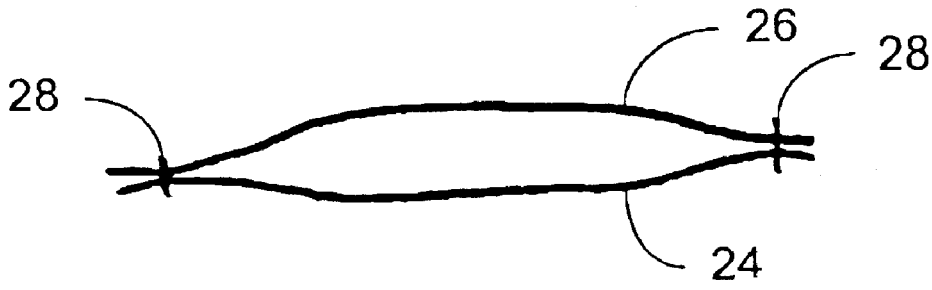
FIG. 3 is a cross-sectional view of a PFD shell and liner pocket.
Figure 4:
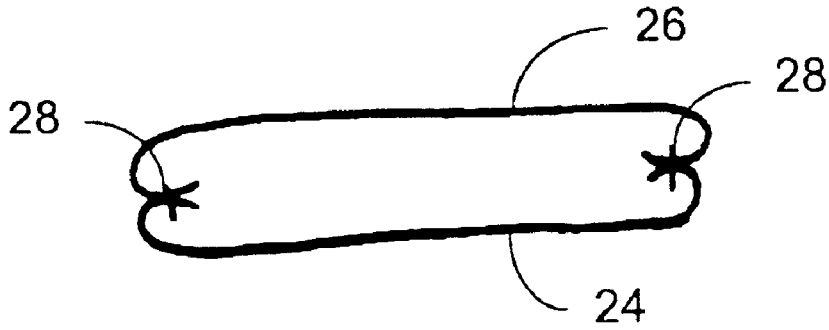
FIG. 4 is a cross-sectional view of the pocket of FIG. 3 turned inside out.
Figure 5:
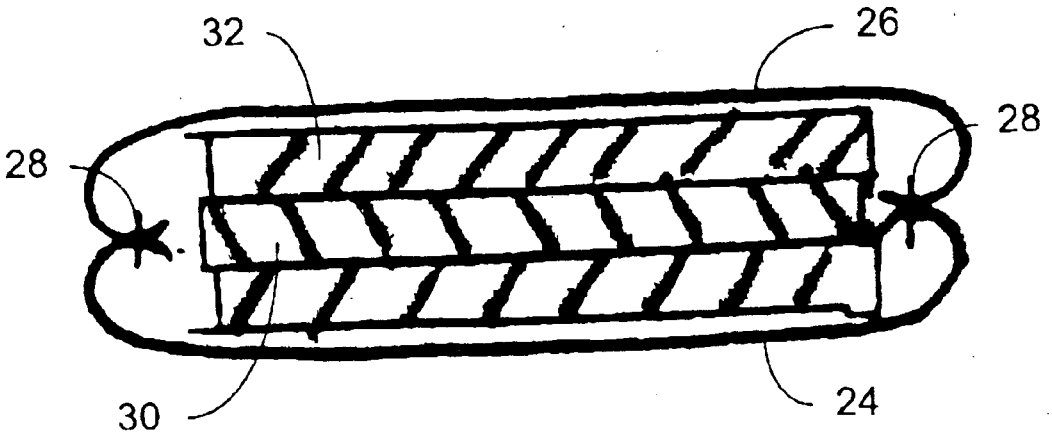
FIG. 5 is a cross-sectional view of the PFD of FIGS. 1 and 2 taken along lines A—A and B—B with layers of flotation foam.

FIGS. 1 and 2 illustrate the front and back views respectively, of a typical PFD. Most PFD's have a vest shape with neck and arm holes to allow freedom of movement. Although the front and back of the PFD shown in FIGS. 1 and 2 appear to be constructed of single panels, or pockets, there are many designs which employ numerous smaller pockets to permit flexible movement by the wearer. Depending upon the PFD design, these pockets can be formed with any desired shape.

Figure 7:
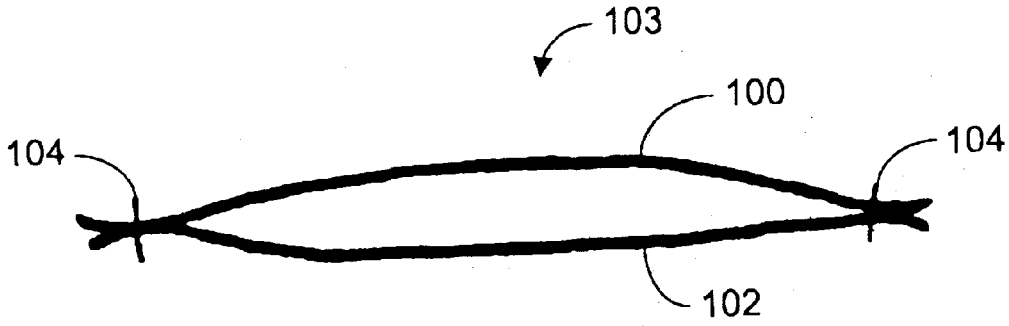
FIG. 7 is a cross-sectional view of a PFD shell and liner pocket according to an embodiment of the present invention.

FIGS. 7 to 10 illustrate the sequential steps in manufacturing a PFD according to the embodiment of the present invention, through cross-sectional views of one pocket taken along either lines A—A or B—B of FIGS. 1 and 2 respectively. In FIG. 7, a shell material 100 and a liner material 102 are placed back-to-back with their exterior surfaces facing each other. The shell 100 and the liner 102 are directly fastened together at their edges to form an open pocket 103. In the embodiment of FIG. 7, the shell 100 and liner 102 are fastened by stitches 104. In alternative embodiments, the shell and the liner can be of the same material, such as nylon. A nylon material such as a 200 denier nylon oxford fabric can be used because of its ability to be sewn, its durability, comfort and pliable properties. Alternatively, any suitable material having similar properties can also be used.

Figure 8:
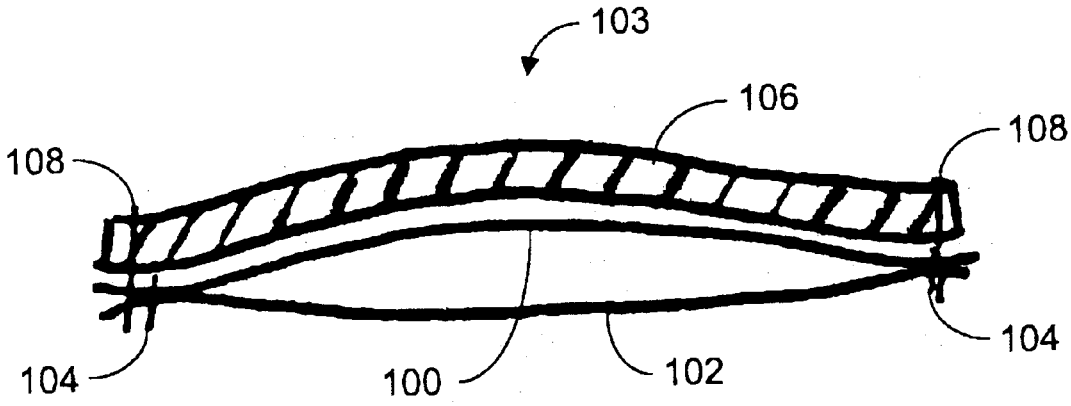
FIG. 8 is a cross-sectional view of the pocket of FIG. 7 with a soft foam layer.

FIG. 8 illustrates the next step of the manufacturing process, in which a soft foam flotation layer 106 is fastened to the exterior of the shell 100 by its edges. Soft foam layer 106 can be an EVA foam, polyethylene or other similar type of foam. As in FIG. 7, stitches 108 are used to fasten the soft foam layer 106 to the shell 100. It should be noted that the soft foam layer 106 has approximately the same width dimension as the shell 100 and liner 102. Although FIG. 8 illustrates the soft foam layer 106 being fastened to the shell 100 after the shell 100 has been fastened to the liner 102, this particular manufacturing step can be combined with the fastening step that occurs in FIG. 7. In other words, the shell 100, liner 102 and the soft foam layer 106 are arranged in the configuration shown in FIG. 8, then stitched together simultaneously. This alternate method can save time in the manufacturing process.

Figure 9:
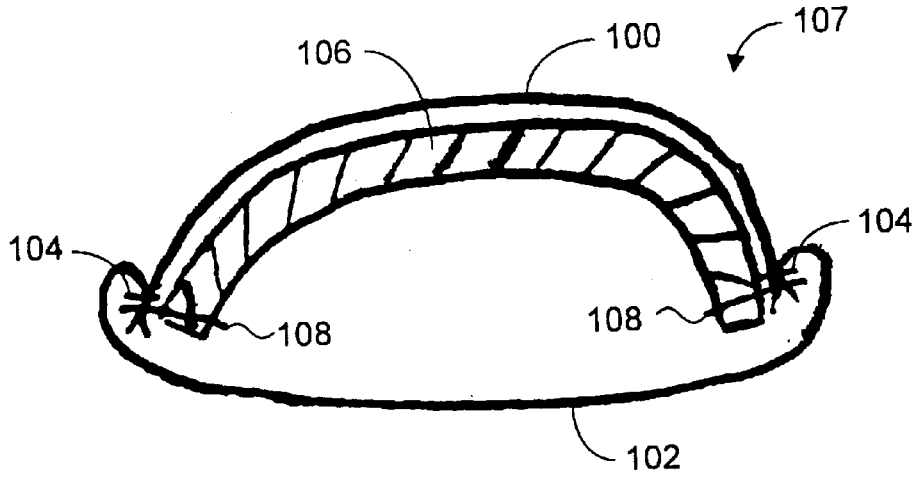
FIG. 9 is a cross-sectional view of the pocket of FIG. 8 turned inside out; and, FIG. 10 is a cross-sectional view of a PFD according to the embodiment of the present invention taken along lines A—A and B—B of FIG. 1.

In FIG. 9, the open pocket 103 with fastened soft foam layer 106 is turned inside out, or inverted, to form an inverted pocket 107. By turning the open pocket 103 inside out, the exterior surface of shell 100 assumes a convex shape due to the force applied by the soft foam layer 106.

Figure 6:
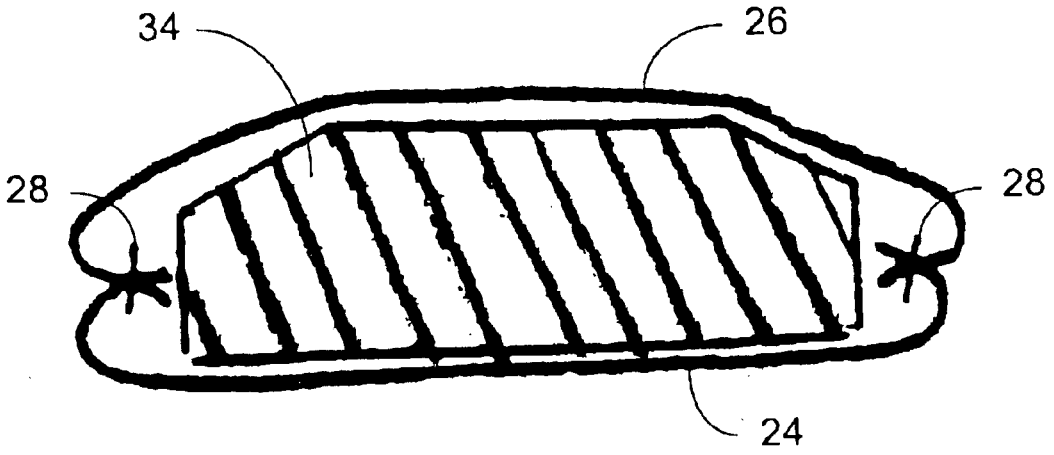
FIG. 6 is a cross-sectional view of the PFD of FIGS. 1 and 2 taken along lines A—A and B—B with a formed single piece of flotation foam.
Figure 10:
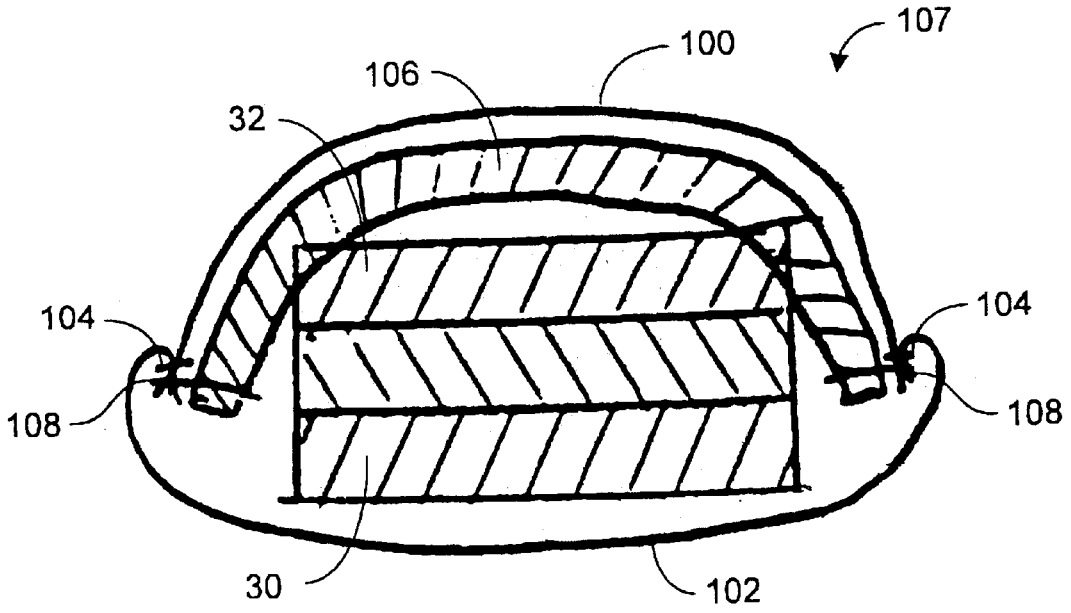

A multi-layered combination of soft foam 30 and hard foam is inserted into the inverted pocket in FIG. 10. Soft foam 30 can be the same type of foam as soft foam layer 106, although different types of soft foam can be used for the multi-layered soft and hard foam insert and the soft foam layer 106. Alternatively, as previously shown in FIG. 6, a single piece of hard foam 34 can be inserted into the inverted pocket. To complete the manufacturing process, the open end of the inverted pocket 107 is fastened together such that the soft foam 106 and the multi-layered combination of soft foam 30 and hard foam 32 are enclosed within the inverted pocket. Thus, the relatively hard edges of the hard foam 32 are covered by the soft foam layer 106 to provide a softer, more comfortable feel to the wearer. In general, hard foam is stiff and does not easily conform to a wearer's body, while soft foam is more pliable. In embodiments where the soft foam is stitched to the shell 100 and liner 102, the soft foam layer 106 should be selected to be a type that does not separate from the stitching area after it is stitched to the shell 100 and liner 102. Hard foam will tend to separate from the stitches because of the stitching process.

Therefore, the PFD manufactured according to the aforementioned embodiment of the present invention is more comfortable to wear than prior art PFD's, less expensive to manufacture than prior art PFD's having similar levels of comfort, and less likely to be removed by the wearer during their activity or even before they engage in their activity. Since a soft foam layer is fastened to the pockets of the PFD, any multi-layered soft and hard foam flotation foam insert can be made thinner by removal of one soft foam layer to reduce the overall bulk and cost of the PFD while maintaining a high level of comfort. Flexibility of the PFD is maximized because the shell and liner layers remain fastened directly to each other without any material between them. Hence the combination of soft pockets and flexibility provided by the PFD according to the embodiment of the present invention minimizes discomfort experienced by the wearer. Moreover, the present method for manufacturing PFD's adds minimal overhead to existing methods for manufacturing prior art PFD's, hence keeping manufacturing costs low.

In alternative embodiments of the present invention, the shell 100 and liner 102 can be fastened together by gluing, taping or heat laminating instead of stitches. The soft foam layer 106 can also be fastened to the shell by gluing, taping or heat laminating instead of stitching. Although the present embodiment of the invention uses a shell material and a liner, other materials that offer similar properties can also be used. Additionally, soft foam layers can be fastened to both the shell and liner materials instead of just one of the material layers as shown in the embodiment of FIG. 10.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A personal flotation device comprising:

at least one pocket having two material layers directly fastened to each other at a seam line adjacent their edges, and at least one soft foam layer fastened to one of the two material layers adjacent the seam line, the at least one pocket being inverted to contain the at least one soft foam layer between the two material layers; and, flotation foam positioned between the soft foam layer and the other of the two material layers such that the soft foam layer enfolds the flotation foam to provide cushioning to a user.

2. The personal flotation device of claim 1, wherein the two material layers include a lining and a shell.

3. The personal flotation device of claim 2, wherein the at least one soft foam layer is fastened to the shell.

4. The personal flotation device of claim 1, wherein the two material layers are fastened to each other at their edges.

5. The personal flotation device of claim 4, wherein the at least one soft foam layer is fastened to one of the two material layers at its edges.

6. The personal flotation device of claim 1, wherein the at least one soft foam layer and the at least one of the two material layers have a convex shape.

7. The personal flotation device of claim 1, wherein the flotation foam includes hard foam.

8. The personal flotation device of claim 1, wherein the flotation foam includes layers of hard foam and soft foam.

9. The personal flotation device of claim 1, wherein the at least one soft foam layer is sewn to one of the two material layers.

10. The personal flotation device of claim 1, wherein the at least one soft foam layer is glued to one of the two material layers.

11. The personal flotation device of claim 1, wherein the at least one soft foam layer is taped to one of the two material layers.

12. The personal flotation device of claim 1, wherein the at least one soft foam layer is heat laminated to one of the two material layers.

13. The personal flotation device of claim 1, wherein one soft foam layer is fastened to each of the two material layers.

14. A method for manufacturing a personal flotation device comprising the steps of:

a) fastening a first material to a second material at their edges to form an open pocket;

b) fastening a soft foam layer to the exterior of the first material by its edges;

c) inverting the open pocket to form an inverted pocket;

d) inserting flotation foam into the inverted pocket; and, e) fastening open ends of the inverted pocket together.

15. The method for manufacturing a personal flotation device of claim 14, wherein the soft foam layer, the first material and the second material are simultaneously sewn together at their edges.

16. The method for manufacturing a personal flotation device of claim 15, wherein the first material is a shell and tire second material is a liner.

17. The method for manufacturing a personal flotation device of claim 14, wherein the soft foam layer is sewn to the exterior of the first material.

18. The method for manufacturing a personal flotation device of claim 14, wherein the soft foam layer is glued to the exterior of the first material.

19. The method for manufacturing a personal flotation device of claim 14, wherein the soft foam layer is taped to the exterior of the first material.

20. The method for manufacturing a personal flotation device of claim 14, wherein the soft foam layer is heat laminated to the exterior of the first material.

* * * * *